US012252223B2

(12) United States Patent
Pedersen et al.

(10) Patent No.: US 12,252,223 B2
(45) Date of Patent: Mar. 18, 2025

(54) OFFSHORE DRILLING VESSEL WITH AN EXTERNAL CABLE CONNECTION AND METHOD THEREFOR

(71) Applicant: NOBLE DRILLING A/S, Kongens Lyngby (DK)

(72) Inventors: Mikkel Søndergaard Pedersen, Thisted (DK); John Røn Pedersen, Frederikssund (DK)

(73) Assignee: NOBLE DRILLING A/S, Kongens Lyngby (DK)

( * ) Notice: Subject to any disclaimer, the term of this patent is extended or adjusted under 35 U.S.C. 154(b) by 434 days.

(21) Appl. No.: 17/636,707

(22) PCT Filed: Aug. 18, 2020

(86) PCT No.: PCT/DK2020/050234
§ 371 (c)(1),
(2) Date: Feb. 18, 2022

(87) PCT Pub. No.: WO2021/032259
PCT Pub. Date: Feb. 25, 2021

(65) Prior Publication Data

US 2022/0289345 A1 Sep. 15, 2022

(30) Foreign Application Priority Data

Aug. 19, 2019 (DK) ..... PA 2019 00976
Dec. 19, 2019 (DK) ..... PA 2019 01511

(51) Int. Cl.
*B63B 35/44* (2006.01)
*B63B 1/10* (2006.01)
(Continued)

(52) U.S. Cl.
CPC ..... *B63B 35/4413* (2013.01); *B63B 1/107* (2013.01); *B63B 35/44* (2013.01);
(Continued)

(58) Field of Classification Search
CPC ..... B63B 35/00; B63B 35/44; B63B 35/4413; B63B 2003/147; B63B 2035/4433;
(Continued)

(56) References Cited

U.S. PATENT DOCUMENTS 4,448,568 A 5/1984 Gentry et al.
5,070,904 A 12/1991 Mcmahon et al.
(Continued)

FOREIGN PATENT DOCUMENTS

EP 2799328 A1 * 11/2014 ..... B63J 3/04
EP 3000716 A1 3/2016
(Continued)

OTHER PUBLICATIONS

"Martin Linge Hooked Up to Shore Power" OE Offshore Engineer, The Future Of Offshore Energy & Technology, Mar. 20, 2019.
(Continued)

*Primary Examiner* — Lars A Olson
(74) *Attorney, Agent, or Firm* — Buchanan Ingersoll & Rooney PC

(57) ABSTRACT

An offshore drilling vessel includes a hull and at least one opening in the hull arranged to receive an end of at least one submersible cable. The offshore drilling vessel also comprises a cable capture mechanism configured to lift the end of the at least one submersible cable through the at least one opening from a submersed position to a raised position. A cable connector is configured to couple to the end of the at least one submersible cable when the end of the at least one submersible cable is in the raised position such that the offshore drilling vessel comprises an external data and/or power connection via the submersible cable.

18 Claims, 10 Drawing Sheets

(51) Int. Cl.
*E21B 15/02* (2006.01)
*B63B 3/14* (2006.01)

(52) U.S. Cl.
CPC ..... *E21B 15/02* (2013.01); *B63B 2003/147* (2013.01); *B63B 2035/4433* (2013.01)

(58) Field of Classification Search
CPC . B63B 1/00; B63B 1/107; E21B 15/00; E21B 15/02
USPC ..... 114/264
See application file for complete search history.

(56) References Cited

U.S. PATENT DOCUMENTS

| | | | |
|---|---|---|---|
| 6,868,902 | B1 | 3/2005 | Roodenburg et al. |
| 2008/0223582 | A1 | 9/2008 | Wille |
| 2011/0005766 | A1 | 1/2011 | Shand |
| 2011/0168075 | A1 | 7/2011 | Yemm et al. |
| 2014/0345872 | A1 | 11/2014 | Zediker |
| 2020/0149373 | A1 | 5/2020 | Souza et al. |

FOREIGN PATENT DOCUMENTS

| | | | |
|---|---|---|---|
| GB | 2122140 | A | 1/1984 |
| GB | 2461713 | A | 1/2010 |
| KR | 20170112319 | A | 10/2017 |
| NO | 174754 | B | 3/1994 |
| WO | 2005090152 | A1 | 9/2005 |
| WO | 2009016346 | A2 | 2/2009 |
| WO | 2012148546 | A1 | 11/2012 |
| WO | 2018232483 | A2 | 12/2018 |

OTHER PUBLICATIONS

"Tapping Shore Power for Offshore Oil and Gas Facilities", OE Offshore Engineer, The Future Of Offshore Energy & Technology, Feb. 5, 2020.

International Search Report (PCT/ISA/210) and Written Opinion (PCT/ISA/237) mailed on Nov. 27, 2020, by the European Patent Office as the International Searching Authority for International Application No. PCT/DK2020/050234. (13 pages).

Danish Search Report issued in corresponding Danish Patent Application No. PA2019 00976 dated Mar. 6, 2020. (8 pages).

Danish Search Report issued in corresponding Danish Patent Application No. PA2019 01511 dated Jul. 31, 2020. (7 pages).

* cited by examiner

OFFSHORE DRILLING VESSEL WITH AN EXTERNAL CABLE CONNECTION AND METHOD THEREFOR

FIELD

The present invention relates to an offshore drilling vessel with an external cable connection.

BACKGROUND

Offshore drilling rigs require significant power to maintain drilling and/or production operations. Known offshore drilling rigs use diesel- or gas-powered generators to maintain a power supply for the offshore drilling rig. This means that many offshore drilling rigs burn fossil fuels during the drilling and/or production operations.

The demand for improved fuel efficiency and reduced emissions is constantly increasing when operating offshore drilling rigs. Accordingly, alternatives to diesel or gas powered generators to maintain a power supply for the offshore drilling rig are being considered.

One solution is to provide the offshore drilling rig with subsea power cable connection to an onshore electrical power distribution and generation network. This is particularly desirable if electricity generated onshore is from renewable energy sources such as wind turbine generators or hydroelectric generators. In this way, the offshore drilling rig can be completely electrified and generate minimal or zero carbon emissions.

A problem with coupling a floating offshore drilling rig with a subsea power cable is that the main deck crane is required to lift the subsea cable up onto the side of the deck which can take considerable time. This means that the main deck crane cannot be used for other operations whilst the subsea cable is installed on the offshore drilling rig. The connection between the offshore drilling rig and the subsea cable is particularly susceptible to damage and wear from the heaving motion of the offshore drilling rig. When the subsea cable is mounted on one side of the main deck, the subsea cable experiences asymmetrical forces due to the heaving motion of the offshore drilling rig.

Examples of the present invention aim to address the aforementioned problems.

SUMMARY

The purpose of the invention is to provide an offshore drilling vessel with an external cable connection providing an external data and/or power connection via a submersible cable.

This purpose is according to the invention achieved by an offshore drilling vessel as defined in claim 1, and a method as defined in claim 14. Preferred embodiments are defined in the dependent claims.

Optionally, the at least one submersible cable is one or more of a high voltage power cable, an alternating current power cable, a direct current power cable, a fibre optic cable, a single mode fibre cable, a multimode fibre cable, an ethernet cable, a USB cable, a telephone wire, unshielded twisted pair cable, shielded twisted pair cable, and/or coaxial cable.

Optionally, the cable connector comprises a slip ring for permitting relative rotational movement between the end of the submersible cable and the offshore drilling vessel.

Optionally, the cable connector comprises a portion mounted on the offshore drilling vessel engageable with another portion mounted on the end of the at least one submersible cable.

Optionally, the first portion and the second portion are selectively engageable.

Optionally, the first portion and second portion are selectively engageable to each other with one or more magnetic fasteners.

Optionally, the first portion is mounted to the slip ring.

Optionally, the cable capture mechanism comprises a lifting cable and winch for lifting the end of the at least one submersible cable between the submersed position and the raised position.

Optionally, the cable capture mechanism comprises a remotely operated underwater vehicle for capturing the free end of the at least one submersible cable in the submersed position.

Optionally, the remotely operated underwater vehicle is configured to move together the lifting cable and the end of the at least one submersible cable in the submersed position.

Optionally, the lifting cable comprises a gripper which is selectively engageable with the end of the at least one submersible cable.

Optionally, the hull comprises a conduit extending between the at least one opening and the cable connector.

Optionally, the conduit comprises at least one valve for selectively allowing passage of the at least one submersible cable through the conduit.

Optionally, the cable connector is mounted in a switchboard room in the offshore drilling vessel.

Optionally, the offshore drilling vessel is a semi-submersible drilling rig and the at least one opening is located in one or more pontoons of the vessel.

Optionally, the cable connector comprises a cable ejection mechanism.

Optionally, the cable ejection mechanism releases the end of the at least one submersible cable from the cable connector.

Optionally, the cable ejection mechanism is arranged to urge the end of the at least one submersible cable towards the at least one opening.

Optionally, when the end of the at least one submersible cable is arranged to move from the raised position to the submersed position in less than five seconds when the cable ejection mechanism is actuated.

Optionally, the offshore drilling vessel is connected to an onshore electrical power generation and distribution network or to an offshore power generation installation via the submersible cable.

Optionally, the offshore power generation installation is one or more offshore wind turbines.

Optionally, the offshore drilling vessel comprises at least one thruster mounted to the hull which is controllable with a dynamic positioning system for maintaining the position of the vessel with respect to the seafloor.

Optionally, the offshore drilling vessel is configured to operate in a dynamic position mode, a moored mode and/or a moored thruster assisted mode.

Optionally, the offshore drilling vessel comprises a cable tension sensor for detecting the tension in the submersible cable. Optionally, the cable ejection mechanism releases the end of the at least one submersible cable from the cable connector if the tension in the submersible cable exceeds a predetermined threshold tension.

Optionally, the method comprises determining that the offshore drilling vessel has met an emergency disconnect condition and releasing the end of the submersible cable.

Various other aspects and further examples are also described in the following detailed description and in the attached claims with reference to the accompanying drawings, in which:

DETAILED DESCRIPTION OF THE DRAWINGS

Figure 1:
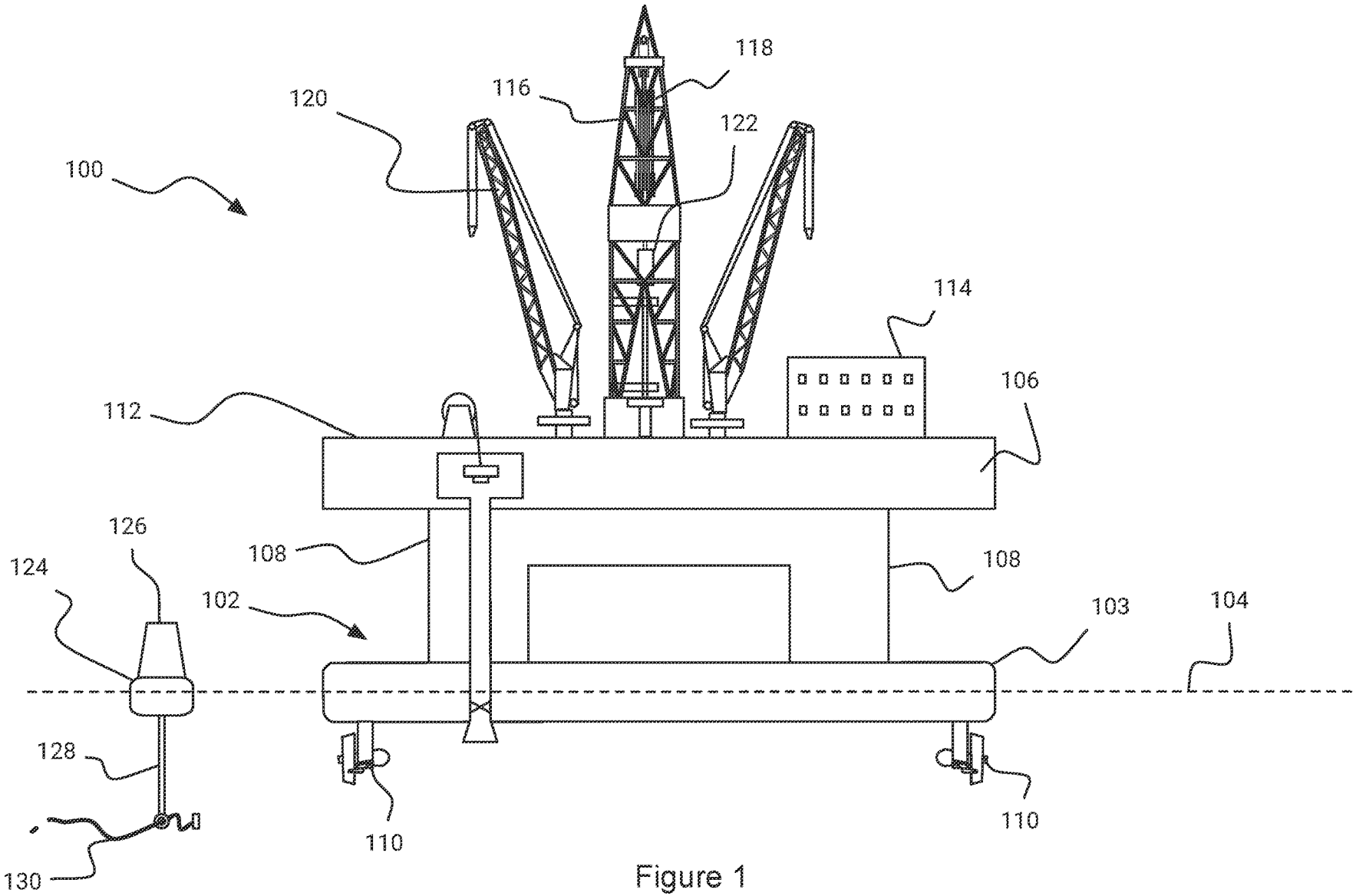
FIGS. 1 to 7 show a side view of an offshore drilling vessel according to some examples.

FIG. 1 shows a side view of an offshore drilling vessel 100. In some examples, the offshore drilling vessel 100 is a semi-submersible drilling rig 100. In some other examples, an offshore drilling vessel 100 may be any vessel that includes machinery and equipment used for drilling a well. Alternatively, the offshore drilling platform 100 may be of a different type such as a drill ship, drilling barge, jack-up drilling rig, or other type of drilling vessel. However, hereinafter the term "offshore drilling vessel" 100 shall be used.

As shown in FIG. 1, the semi-submersible drilling rig 100 comprises a hull 102. The hull 102 comprises or more buoyancy pontoons 103 which are mounted to the hull 102 and located at least partially below the surface 104 of the water and wave action. However, FIG. 1 shows the surface 104 of the water reaching part way up the side of the buoyancy pontoons 103. In some examples, the buoyancy of the buoyancy pontoons 103 can be adjusted and the buoyancy pontoons 103 can be positioned lower in the water (e.g. submerged).

An operation platform 106 is mounted on the hull 102 and the operation platform is elevated above the surface 104 of the water and supported by one or more column structures 108 extending from the buoyancy pontoons 103 to the operation platform 106.

FIG. 1 shows an offshore drilling vessel 100 that is connected to and supports one end of a riser (not shown), which may be a drilling riser. The riser extends from the offshore drilling vessel 100, underwater to connect to a structure such as a blow-out preventer (BOP) (not shown) on the seabed (not shown). In some examples, the riser may be provided with a pair of flex joints, one at the surface end and one at the subsea end. Furthermore, although the riser is connected at the subsea end to a BOP, it will be appreciated that the riser could be connected to any other suitable wellhead apparatus, such as a Xmas tree.

The operation platform 106 comprises a main deck 112 and an accommodation structure 114 mounted thereon for housing personnel. A drilling support structure 116 is also mounted on the operation platform 106. In some examples, the drilling support structure 116 is a mast or derrick. In other examples, the drilling support structure 116 is any suitable structure for supporting equipment. As shown in FIG. 1, the drilling support structure 116 extends upwardly from the operation platform 106 and supports a hoisting system 118 e.g. such as a draw works hoisting system 118 and a top drive 122.

In some examples, the drilling support structure 116 is moveably mounted on the main deck 112. The moveable drilling support structure 116 allows drilling equipment or other equipment for operating or exploring a well to be translated with respect to the hull 102. In some examples, moveable drilling support structure 116 is mounted on the main deck 112 via rails that allow the moveable drilling support structure 116 to move or "skid" over the main deck 112. For the purposes of clarity, the rails have not been shown in the Figures. In some other examples, the drilling support structure 116 is fixed with respect to the hull 102 and does not move with respect to the hull 102.

One or more cranes 120 are mounted on the main deck 112 for lifting and moving equipment on the offshore drilling vessel 100. For the purposes of clarity, only one of the cranes 120 has been labelled in FIG. 1.

Operation of the drilling operations of the offshore drilling vessel 100 is known and will not be discussed any further.

Figure 8:
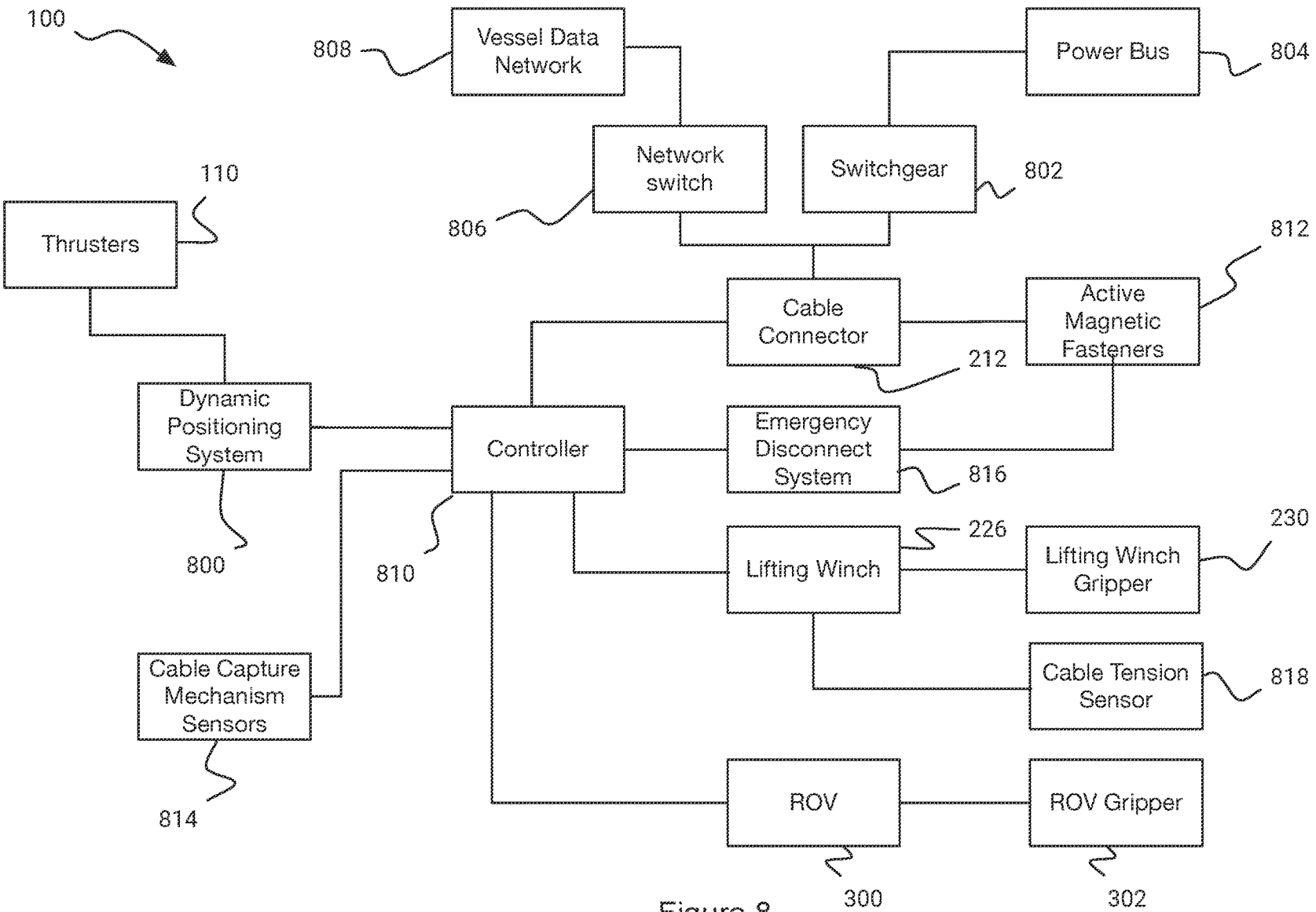
FIG. 8 shows a schematic view of an offshore drilling vessel according to some examples.

The offshore drilling vessel 100 can be moved, e.g. due to currents, waves and wind, and is maintained in a target position with respect to the seafloor using a dynamic positioning system 800 (as best shown in FIG. 8). FIG. 8 shows a schematic representation of the offshore drilling vessel 100.

The offshore drilling vessel 100 comprises a plurality of propulsion devices such as thrusters 110. In other examples, other propulsion devices such as propellers, azimuthal podded drives or any other propulsor for generating thrust can be used. The thrusters 110 are configured to propel the offshore drilling vessel 100 in different directions and are selectively controllable to adjust the position of the offshore drilling vessel 100.

The dynamic positioning system 800 of the offshore drilling vessel 100 is configured to determine the position of the offshore drilling vessel 100, compare the determined position of the offshore drilling vessel 100 with a target position and determine corrective control actions for specific thrusters 110 to, as far as possible, maintain offshore drilling vessel 100 substantially in the target position.

The dynamic positioning system 800 can determine the position of offshore drilling vessel 100 using a range of sensors (not shown), such as satellite positioning sensors, beam based triangulation or relative positioning sensors, wire tension monitoring systems, sea monitoring sensors (e.g., acoustics), and/or the like.

In some examples, the dynamic positioning system 800 is used maintaining the position of the vessel with respect to the seafloor. This means that the offshore drilling vessel 100 can be positioned, and kept in position, near one or more submersible cables 130.

In some examples, the offshore drilling vessel 100 can be maintained in a target position over the seafloor in a "dynamic positioning mode". That is, the offshore drilling vessel is kept in position using only the dynamic positioning system 800. In other examples, the offshore drilling vessel 100 can be moored and the dynamic positioning system 800 is used together with the mooring to maintain the offshore drilling vessel 100 over the target position. This is also known as a "moored thruster assist mode". In other examples, the use of the dynamic positioning system is optional. In this case, the offshore drilling vessel 100 is maintained in the target position with moorings. This is also known as a "moored mode". Furthermore, if the offshore drilling vessel 100 is a drilling barge, then optionally the drilling barge does not have any thrusters 110 and the drilling barge is towed into position and moored in the target position.

FIG. 1 shows one submersible cable 130 attached to a cable positioning buoy 124. The cable positioning buoy 124 comprises a surface beacon 126 and a submerged cable holder 128. The surface beacon 126 may comprise a bright colour so that it can be seen on the surface 104 of the water. In some examples, the surface beacon 126 may comprise an active signal such as a flashing light and/or a broadcasting radio signal. In order to keep the cable positioning buoy 124 stationary with respect to the seafloor, the cable positioning buoy 124 can be anchored. In some examples, the cable positioning buoy 124 can be tethered to the seafloor or may comprise a sea anchor (not shown).

The submerged cable holder 128 of the cable positioning buoy 124 as shown in FIG. 1 is coupled to a single submersible cable 130. However, in other examples, the cable positioning buoy 124 may hold a plurality of submersible cables 130. For example, the cable positioning buoy 124 may hold a high voltage cable 130 and a data connection cable for connection with the offshore drilling vessel 100. The submerged cable holder 128 in some examples is a loop through which the submersible cable 130 is threaded. This means that the submersible cable 130 can be pulled through the submerged cable holder 128 as required.

In some examples, the at least one submersible cable 130 is a power cable for providing a connection to an external electrical power source. In some examples, the submersible cable 130 is a power cable which is connected to an onshore electrical power and distribution network. In some examples, the onshore electrical power and distribution network comprises renewable electrical generators such as hydroelectric generators. In some other examples, the submersible cable 130 is a power cable which is connected to an offshore power generation installation. In some examples, the offshore power generation installation is one or more offshore wind turbines.

In some examples, the at least one submersible cable 130 is one or more of a high voltage power cable, an alternating current power cable, and/or a direct current power cable.

Additionally or alternatively, in some examples, the at least one submersible cable 130 is a data cable for providing a connection to an external data network. In some examples, the at least one submersible cable 130 is one or more of a fibre optic cable, a single mode fibre cable, a multimode fibre cable, an ethernet cable, a USB cable, a telephone wire, unshielded twisted pair cable, shielded twisted pair cable, and/or coaxial cable.

Figure 7:
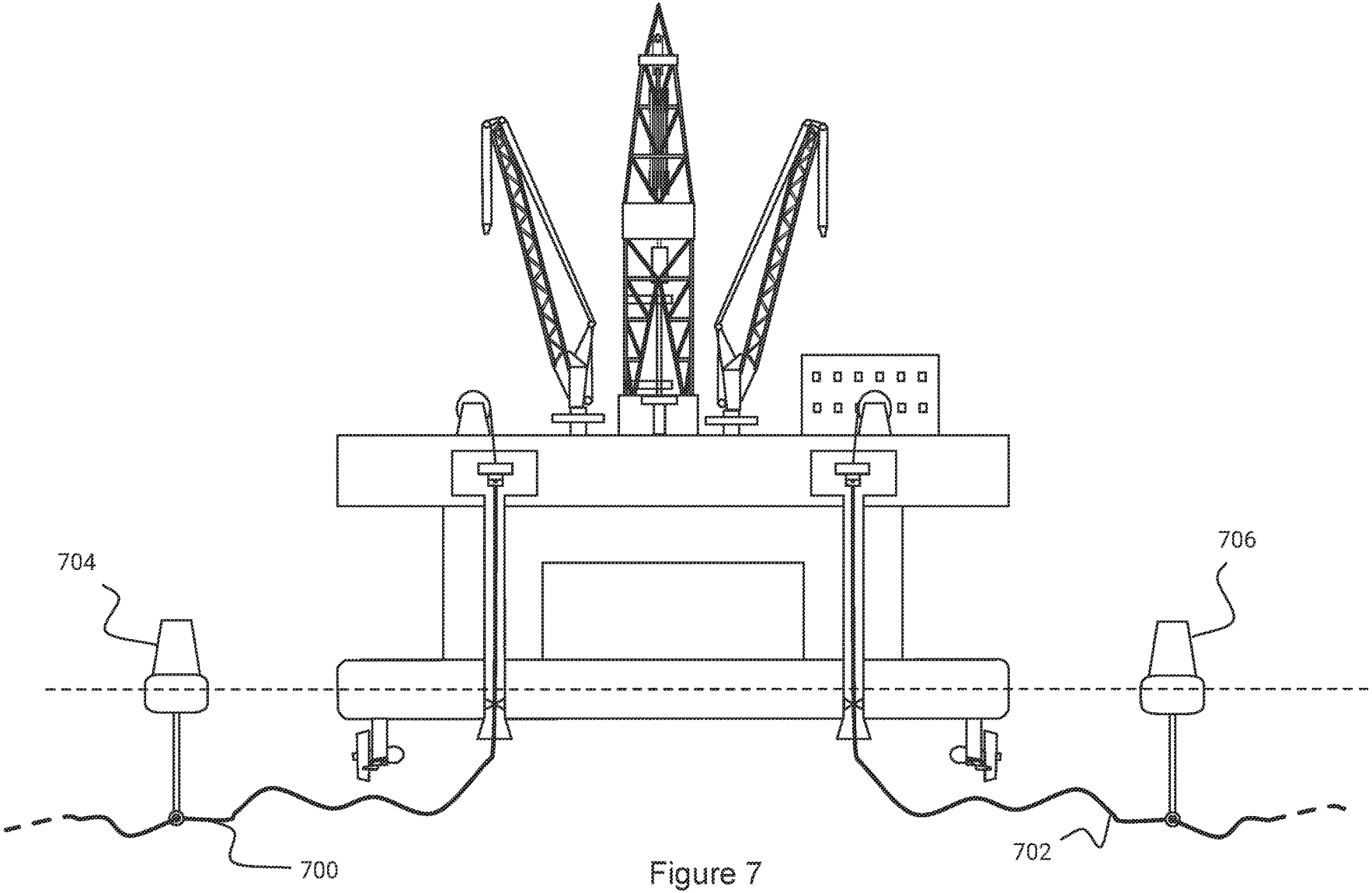

In some examples, there is a submersible power cable 700 and a separate submersible data cable 702. FIG. 7 shows such an arrangement whereby a first cable positioning buoy 704 holds the submersible power cable 700 at a first position and a second cable positioning buoy 706 holds the submersible data cable 702 at a second position. The examples discussed in reference to the other Figures are also applicable to the example shown in FIG. 7. For example, the method and apparatus for connecting and disconnecting the submersible cable 130 is the same for the submersible power cable 700 and the submersible data cable 702 as shown in FIG. 7.

However, in some alternative examples, the submersible cable 130 as shown in FIG. 1 is both a power cable and a data cable. In this example, the submersible cable 130 comprises a central power cable and a data cable wound around the outside of the power cable.

Whilst FIGS. 1 to 7 show one or more cable positioning buoys 124, 704, 706, in another example, the cable positioning buoys 124, 704, 706 are omitted. In this example, the submersible cable 130 rests on the seafloor without a floating indicator on the surface. Optionally, the submersible cable 130 can be tethered or anchored to the seafloor.

Turning to FIGS. 2 to 6, the method of connecting the offshore drilling vessel 100 to the submersible cable 130 will now be described. FIGS. 2 to 6 show a side view of an offshore drilling vessel 100 according various stages in connecting the submersible cable 130 to the offshore drilling vessel 100.

Figure 2:
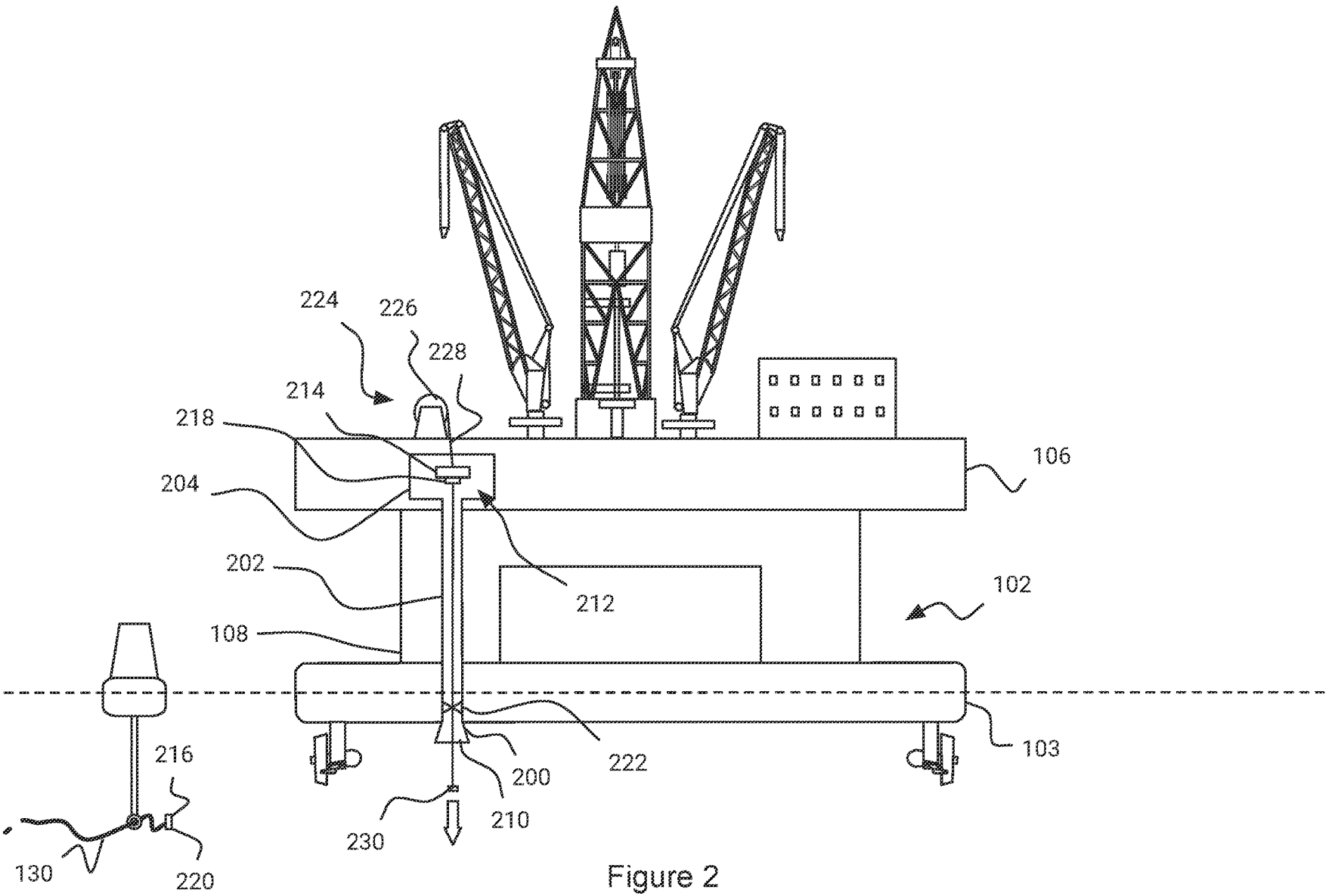

In some examples, the offshore drilling vessel 100 comprises at least one opening 200 in the hull 102 for receiving the submersible cable 130 therethrough. In some examples, the opening 200 is in the bottom of the hull 102. Accordingly, as shown in FIG. 2, the opening 200 is positioned underneath the buoyancy pontoon 103. In other examples, the opening 200 is positioned at the side of the hull, for example in the side of the buoyancy pontoon 103, the operation platform 106, and/or the column structures 108.

The opening 200 is positioned at one end of a conduit 202 which extends through the hull 102 and the offshore drilling vessel 100. In some examples, the conduit 202 extends into the operation platform 106. As shown in FIG. 2, the conduit 202 is connected to a switchboard room 204. The switchboard room 204 houses one or more electrical equipment for distribution of electrical power in the offshore drilling vessel 100. In some examples, the conduit 202 extends into another room (not shown), separate from the switchboard room 204. This may be desirable if there are concerns about introducing water into the switchboard room 204.

In some examples, the switchboard room 204 may comprise switchgear 802 such as switches, fuse, circuit breakers, fuses etc. In some examples, the submersible cable 130 is a submersible power cable 130 and is connectable to the switchgear 802 in the switchboard room 204 such that the submersible power cable 130 is connected to the power bus 804 of the offshore drilling vessel 100.

Similarly, in some examples, the submersible cable 130 is a submersible data cable 130 and the switchboard room 204 may comprise one or more network switches 806 connectable to the submersible data cable 130. In this way, the submersible data cable 130 is connected to the vessel data network 808 of the offshore drilling vessel 100.

In some examples, the conduit 202 extends through the column structures 108. In some examples, the conduit 202 is straight without any bends or turns such that the opening 200 is positioned underneath the switchboard room 204. By having a straight conduit 202, the submersible cable 130 more easily passes through the conduit 202. The conduit 202 comprises a diameter such that the submersible cable 130 can freely move through the conduit 202 such that the submersible cable 130 does not snag on the walls of the conduit 202.

In some examples, the opening 200 optionally comprises a flared funnel 210 for receiving the end 220 of the submersible cable 130. The flared funnel 210 guides the end 220 of the submersible cable 130 into the conduit 202. In other examples, the opening 200 is flush with the surface of the hull 102 or the buoyancy pontoon 103.

A cable connector 212 is mounted within the switchboard room 204. The cable connector 212 is configured to couple to the end 220 of the at least one submersible cable 130. In some examples, the cable connector 212 is part of a plug and socket arrangement with the end 220 of the submersible cable 130. In some examples, optionally, the cable connector 212 comprises a slip ring 214. The slip ring 214 is arranged to permit relative rotational movement between the end 220 of the submersible cable 130 and the offshore drilling vessel 100. In some examples, the slip ring 214 is configured to receive a high voltage power cable and/or a fibre optic cable.

In some examples, the cable connector 212 comprises a first portion 216 mounted on the end 220 of the submersible cable 130 and a second portion 218 mounted on the offshore drilling vessel 100. The first and second portions 216, 218 are configured to mechanically couple to each other such that the submersible cable 130 maintains a secure connection to the offshore drilling vessel 100 after installation of the submersible cable 130.

In some examples, the first portion 216 and the second portion 218 are engageable. The first and second portion 216, 218 may comprise one or more fasteners 812 for maintaining the secure connection. In some examples, the one or more fasteners 812 are remotely operated by a controller 810. In this way, the controller 810 can send a signal to the one or more fasteners 812 to engage or disengage and thereby cause the first portion 216 and the second portion 218 to be secured to one another or not. The one or more fasteners 812 in some examples are mechanical locking mechanism which are actuated with servos controlled by the controller 810.

Alternatively, the first portion 216 and second portion 218 are selectively engageable with one or more magnetic fasteners 812. In this way, the first portion 216 and the second portion 218 are part of an active magnetic system. The active magnetic system comprises a solenoid in the first portion 216 for generating a magnetic field and fastening the first and second portions 216, 218 together. In some examples, the second portion 218 is mounted on the slip ring 214. This means that when the active magnetic system is actuated by the controller 810, the first and second portions 216, 218 rotate with respect to the offshore drilling vessel 100.

The conduit 202 comprises at least one valve 222 for selectively allowing passage of the submersible cable 130 through the conduit 202. In some examples, the valve 222 is a gate valve 222, but in other examples, the valve 222 can be any suitable valve for selectively opening or closing the conduit 202. When the valve 222 is open, the submersible cable 130 can be moved from the opening 200 to the switchboard room 204. When the valve 222 is closed, the submersible cable 130 is prevented from entering the conduit 202. Furthermore, when the valve 222 is closed, water is also prevented from entering the conduit 202. The conduit 202 extends from the underside of the hull 102 to a position above the surface 104 of the water e.g. on the operation platform 106. In this way, even if the valve 222 is open, the water only extends up the conduit 202 as far as the surface of the water 104.

The offshore drilling vessel 100 comprises a cable capture mechanism 224 configured to lift the end 220 of the submersible cable 130 through the at least one opening 200 from a submersed position to a raised position. The submersed position of the submersible cable 130 is a position in the water below the hull 102. The raised position is a position above the submersed position whereby the end 220 of the submersible cable 130 can be operatively connected to the offshore drilling vessel 100. When the end 220 of the submersible cable 130 is in the raised position the offshore drilling vessel 100 comprises an external data and/or power connection via the submersible cable 130.

In some examples, the cable capture mechanism 224 comprises a lifting winch 226 and a lifting cable 228. In other examples, the cable capture mechanism 224 can be any suitable mechanism for securing and lifting the submersible cable 130 from the submersed position to the raised position. In other examples, the cable capture mechanism 224 can be a telescopic robotic arm (not shown).

The lifting winch 226 is mounted on the main deck 112 of the operation platform 106 and is controlled by the controller 810. The lifting cable 228 comprises a lifting winch gripper 230 which is fixed to the free end of the lifting cable 228. In some examples, the lifting winch gripper 230 is a hook or other suitable shaped tool for capturing the submersible cable 130. In other examples, the lifting winch gripper 230 comprises hydraulically actuated grippers.

In some further examples, the lifting winch gripper 230 alternatively or additionally comprises an active magnetic gripper which is arranged to secure and capture the end 220 of the submersible cable 130. In this way, the first portion 216 is used with the lifting winch gripper 230 to capture the submersible cable 130 using another active magnetic fastening system.

As shown in FIG. 2, the lifting winch 226 has lowered the lifting cable 228 down through the conduit 202 in the direction of the arrow. The controller 810 issues a control signal to the cable lifting winch 226 to lower the lifting cable 228. The lifting cable 228 has been lowered to a position such that the lifting winch gripper 230 has passed through the opening 200. The controller 810 issues a control signal for the lifting cable to be lowered a predetermined amount (for example the length of the conduit 202). Alternatively, the controller 810 issues control signals to the lifting winch 226 optionally based on sensor signals received from one or more cable capture mechanism sensors 814. The one or more cable capture mechanism sensors 814 can be one or more of the following: a camera, a proximity detector, sonar or any other suitable sensor.

In some examples, the offshore drilling vessel 100 may be positioned with the dynamic positioning system 800 such that the opening 200 is directly above the end 220 of the submersible cable 130. In this way, the lifting winch gripper 230 does not need to be moved laterally underneath the hull 102 towards the end 220 of the submersible cable 130 after being lowered through the conduit 202.

However, in some situations, the end 220 of the submersible cable 130 may not be positioned underneath the opening 200. In this case, the lifting winch gripper 230 is moved towards the end 220 of the submersible cable 130.

Figure 3:
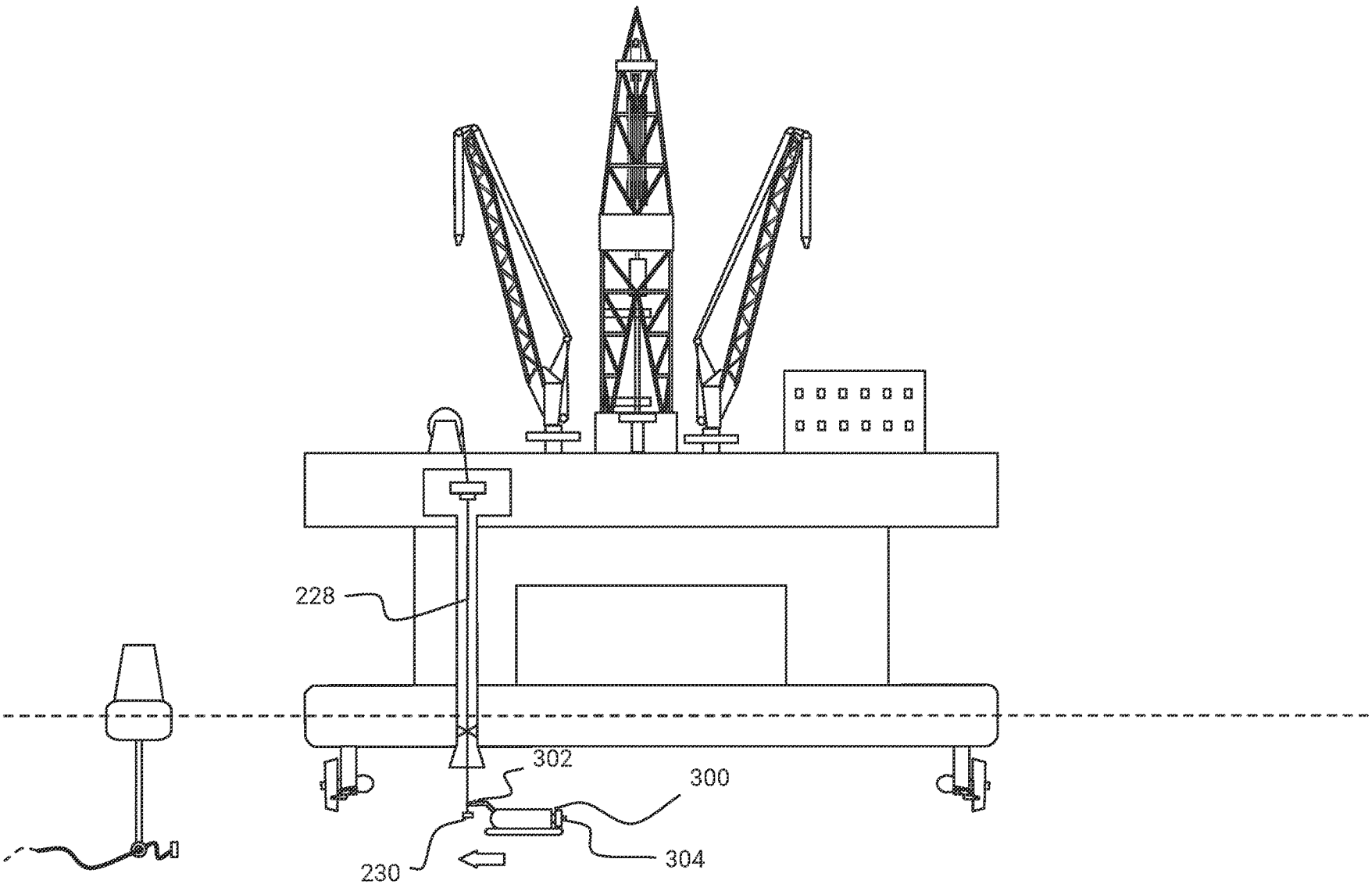

FIG. 3 shows a remote operated underwater vehicle (ROV) 300 underneath the offshore drilling vessel 100. The cable capture mechanism 224 comprises the ROV 300 for capturing the free end 220 of the submersible cable 130 in the submersed position. In some examples, the ROV 300 receives control signals from the controller 810 for remotely and/or autonomously controlling the ROV 300. In some other examples, the ROV 300 can be manually operated.

The ROV 300 is configured to move together the lifting cable 228 and the lifting winch gripper 230 to the end 220 of the submersible cable 130. The ROV 300 comprises a ROV gripper 302 which is selectively engageable with the end 220 of the submersible cable 130 and/or the lifting cable 228. The ROV 300 comprises multidirectional thrusters 304 and ballast tanks (not shown) for controlling the movement, direction and depth of the ROV 300. The ROV gripper 302 can comprise a hook, a hydraulically actuated gripper, a magnetic gripper or any other suitable mechanism for securely gripping the lifting cable 228.

The ROV 300 may comprise one or more cable capture mechanism sensors 814 for manoeuvring the ROV 300 and operating the ROV gripper 302. The controller 810 sends control signals to the ROV 300 to position the ROV gripper 302 around the lifting cable 228 and grasp the lifting cable 228.

FIG. 3 shows the ROV gripper 302 gripping the lifting cable 228 and is moving the lifting cable 228 in the direction of the arrow. Alternatively, the ROV 300 grips the submersible cable 130 and pulls the submersible cable 130 towards the opening 200. It is preferable for the ROV 300 to pull the lifting cable 228 towards the submersible cable 130 because the lifting cable 228 is lighter than the submersible cable 130.

As the ROV 300 pulls the lifting cable 228 towards the end 220 of the submersible cable 130, the lifting winch 226 releases the lifting cable 228.

Figure 4:
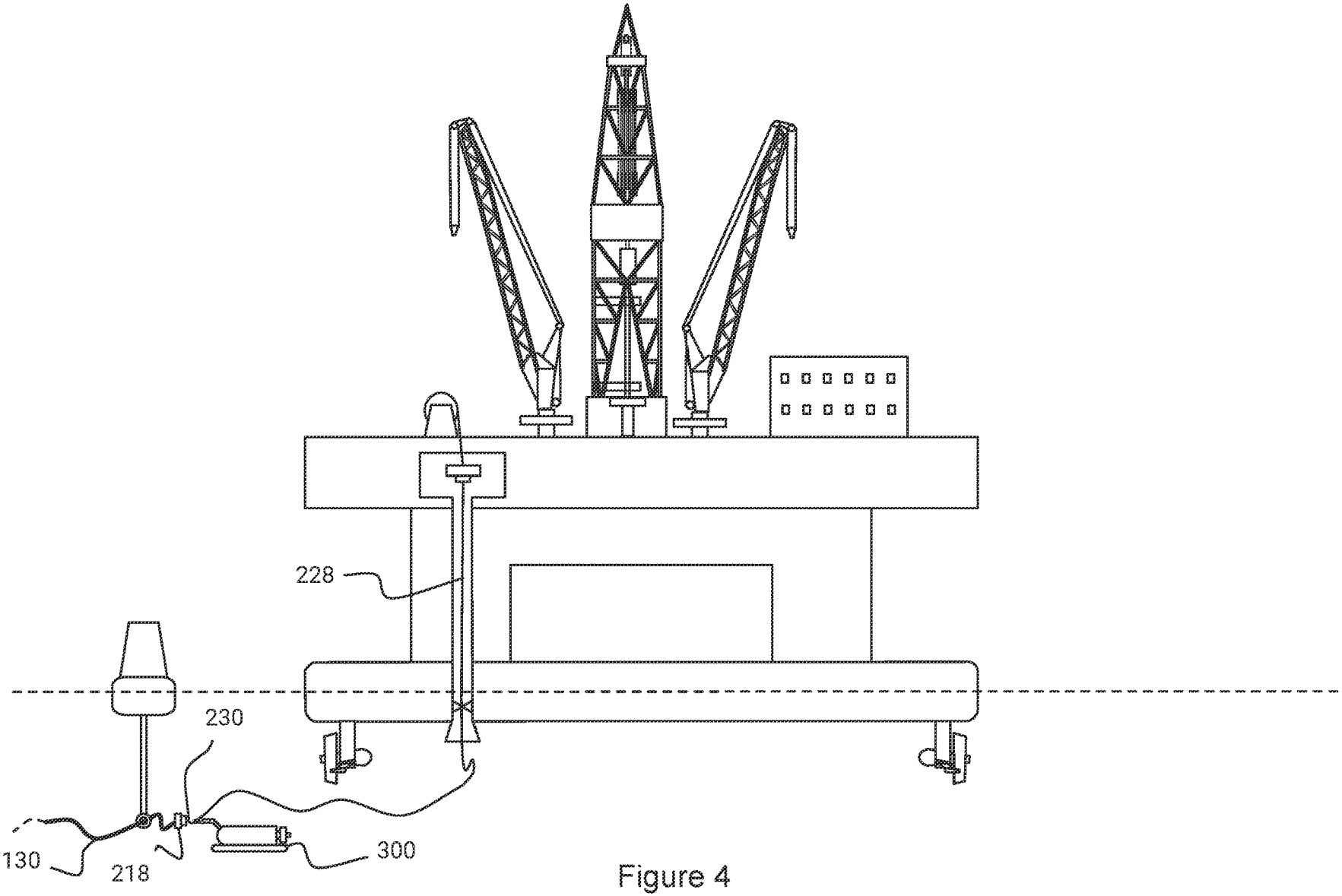

The ROV 300 guides the lifting winch gripper 230 near the second portion 218 at the end 220 of the submersible cable 130 as shown in FIG. 4. The controller 810 sends a signal to the lifting winch gripper 230 to activate and grip the second portion 218. In some examples, the controller 810 energises the magnetic lifting winch gripper 230 and the second portion 218 is magnetically attached to the lifting winch gripper 230. In some examples, the ROV 300 is tethered to the offshore drilling vessel 100. The tether may provide power and control signals to the ROV 300. In other examples, the ROV is not tethered to the to the offshore drilling vessel 100 and is remotely or autonomously controllable without a tether.

Once the lifting cable 228 is securely fastened to the submersible cable 130, the ROV 300 releases the lifting cable 228 and the ROV 300 moves away from both the lifting cable 228 and the submersible cable 130.

FIGS. 3 and 4 show the lifting cable 228 being laterally moved underneath the hull 102 with a ROV 300. However, in other examples, any suitable means can be used for moving the lifting cable 228 towards the end 220 of the submersible cable 130. In some examples, a telescopic arm mounted on the underside of the hull 102 can grip and move the lifting cable 228 towards the end 220 of the submersible cable 130. In some examples, the ROV 300 may be completely autonomous and does not receive any control signals from the controller 810.

Figure 9:
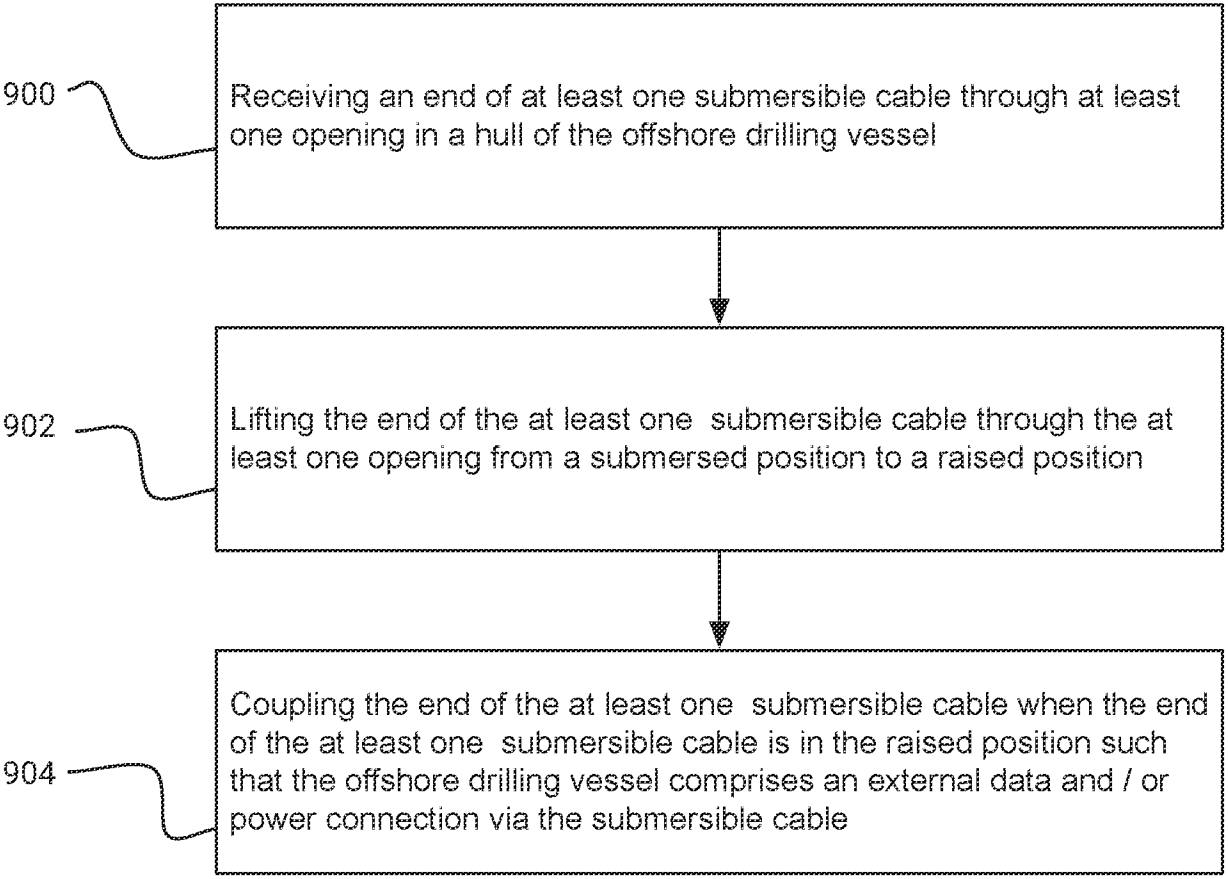
FIGS. 9 and 10 show a flow diagram of a method according to some examples.

The controller 810 then sends a signal to the lifting winch 226 to retract the lifting cable 228 such that an end 220 of at least one submersible cable 130 is received through at least one opening 200 in a hull 102 of the offshore drilling vessel 100 as shown in step 900 of FIG. 9. FIG. 9 shows a flow diagram of the method of connecting the submersible cable 130 to the offshore drilling vessel 100.

Figure 5:
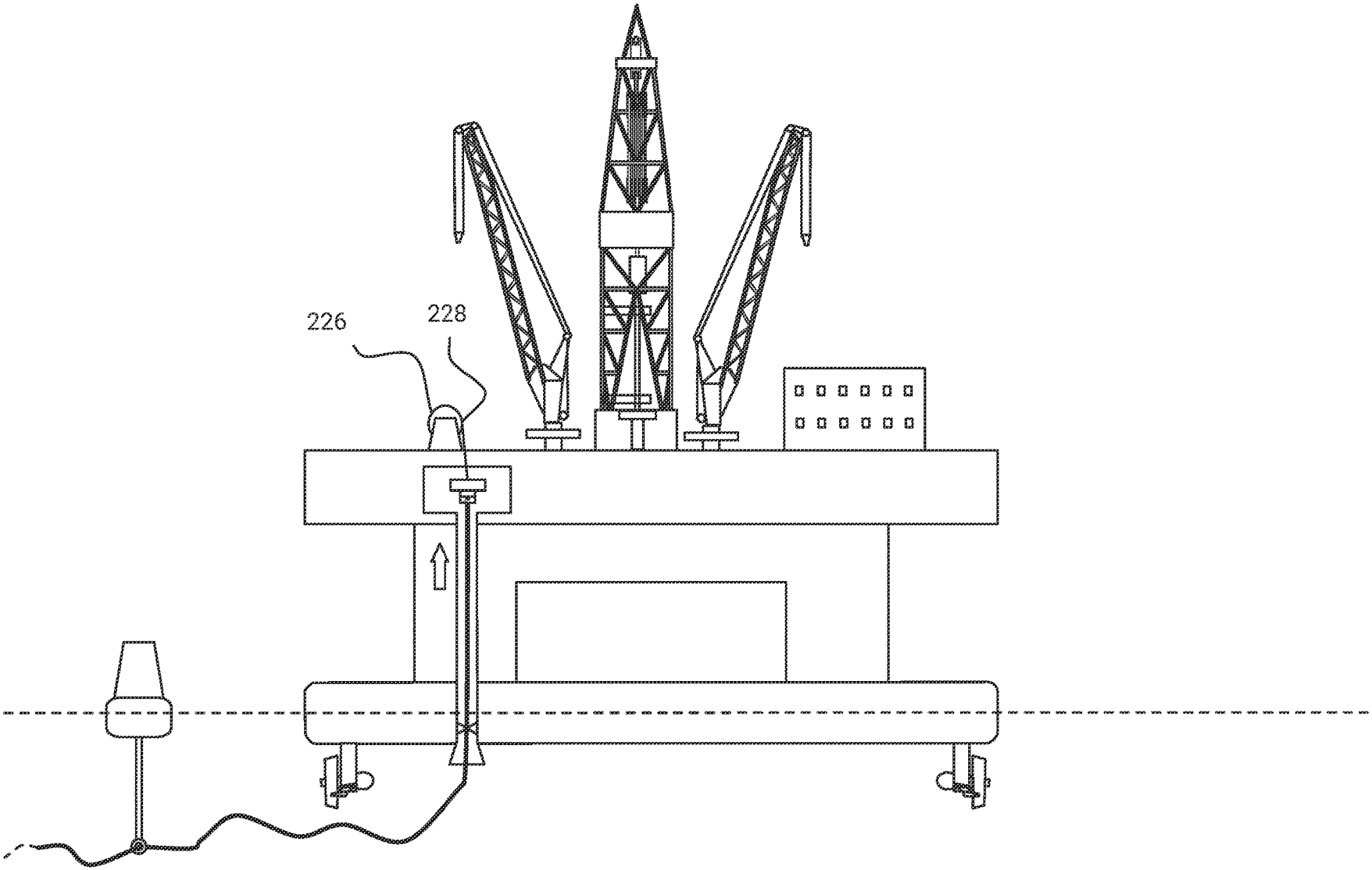

FIG. 5 shows the lifting cable 228 having been fully retracted. The lifting cable 228 is retracted in the direction of the arrow shown in FIG. 5. Here the submersible cable 130 has been lifted from the submersed position to the raise position through the opening 200 as shown in step 902 of FIG. 9. Once the lifting cable 228 is fully retracted, the controller 810 sends a signal to the active magnetic fasteners 812 to energise. Accordingly, the first portion 216 and the second portion 218 are magnetically coupled and securely connected to the offshore drilling vessel 100 such that the offshore drilling vessel 100 comprises an external data and/or power connection via the submersible cable 130 as shown in step 904 of FIG. 9.

Since the submersible cable 130 is connected in a substantially vertical direction, lateral forces on the submersible cable 130 and the cable connector 212 due to the heaving motion of the offshore drilling vessel 100 is reduced. Furthermore, the deck mounted cranes 120 are not required for lifting and installation of the submersible cable 130.

In some examples, the lifting cable 228 remains connected to the submersible cable 130 after the first portion 216 and the second portion 218 are coupled together and securely connected. In this way, the lifting cable 228 takes all the weight and tension forces in the connected submersible cable 130. This means that the weight of the submersible cable 130 and other forces such as heave and tie do not act on the cable connector 212. This prevents damage to the cable connector 212.

In some examples, the lifting cable 228 is optionally coupled to a cable tension sensor 818. In some examples, the cable tension sensor 818 is in line with the lifting cable 228. In other examples, the cable tension sensor 818 is alternatively or additionally connected to the lifting winch 226. In some examples, additionally or alternatively, the submersible cable 130 comprises a cable tension sensor (not shown).

The cable tension sensor 818 sends a signal to the controller 810 comprising information relating to the real-time tension in the lifting cable 228. The controller 810 determines whether the tension in the lifting cable 228 exceeds a predetermined threshold. For example, the controller 810 compares the real-time tension in the lifting cable 228 against a predicted weight of the submersible cable 130. The predicted weight of the submersible cable 130 may be based on the type of submersible cable 130, the height of the raised position above the submerged position and the weather conditions. If the controller 810 determines that the tension in the lifting cable 228 exceeds a predetermined threshold tension, then the controller 810 determines that the lifting cable 228 is experiencing tension forces not associated with normal operation. Accordingly, the controller 810 can issue a signal to the emergency disconnect system 816 for disconnecting the submersible cable 130 from the offshore drilling vessel 100 as discussed below. In this way, if another vessel is attempting to pull the submersible cable 130 away, the offshore drilling vessel 100 can disconnect from the submersible cable 130 before the cable connector 212, submersible cable 130 or any other part of the offshore drilling vessel 100 is damaged.

Figure 10:
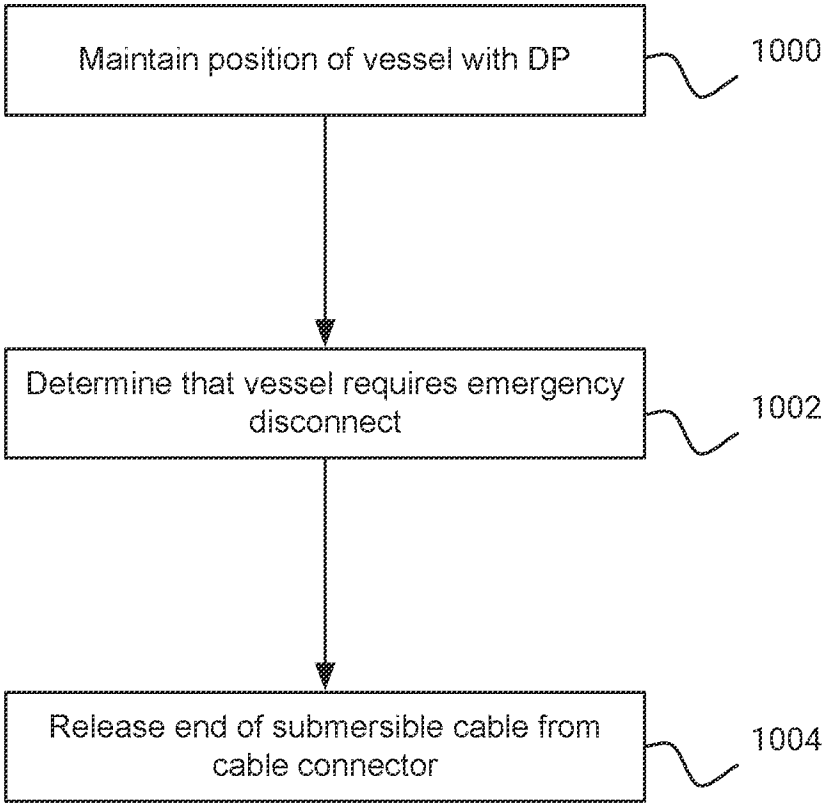

In normal operation, the dynamic positioning system 800 maintains the position of the offshore drilling vessel 100 as shown in step 1000 of FIG. 10. In some operational scenarios, the offshore drilling vessel 100 is required to move away from the target location and perform and emergency disconnect. For example, the dynamic positioning system 800 may not be able to maintain the position of the offshore drilling vessel 100 due to harsh weather conditions. This means that the offshore drilling vessel 100 must disconnect from the lower riser package and wellhead in order to protect both the well and the offshore drilling vessel 100.

If the offshore drilling vessel 100 experiences an emergency disconnect condition, then the offshore drilling vessel 100 must no longer be tethered to the seafloor. This means that the one or more submersible cables 130 that have been connected to the offshore drilling vessel 100, must be disconnected.

In some examples, the controller 810 receives a signal from the dynamic positioning system 800 that the offshore drilling vessel 100 is no longer maintaining its position as shown in step 1002 of FIG. 10. FIG. 10 shows a flow diagram of the method of disconnecting the submersible cable 130 from the offshore drilling vessel 100. The controller 810 issues a signal to the emergency disconnect system 816. The emergency disconnect system 816 disengages the offshore drilling vessel 100 from all tethers to the seafloor including the risers and the submersible cables 130. The emergency disconnect system 816 comprise a cable ejection mechanism 600. In some examples, the cable ejection mechanism 600 can be any suitable mechanism for releasing the submersible cable 130 from the offshore drilling vessel 100.

Figure 6:
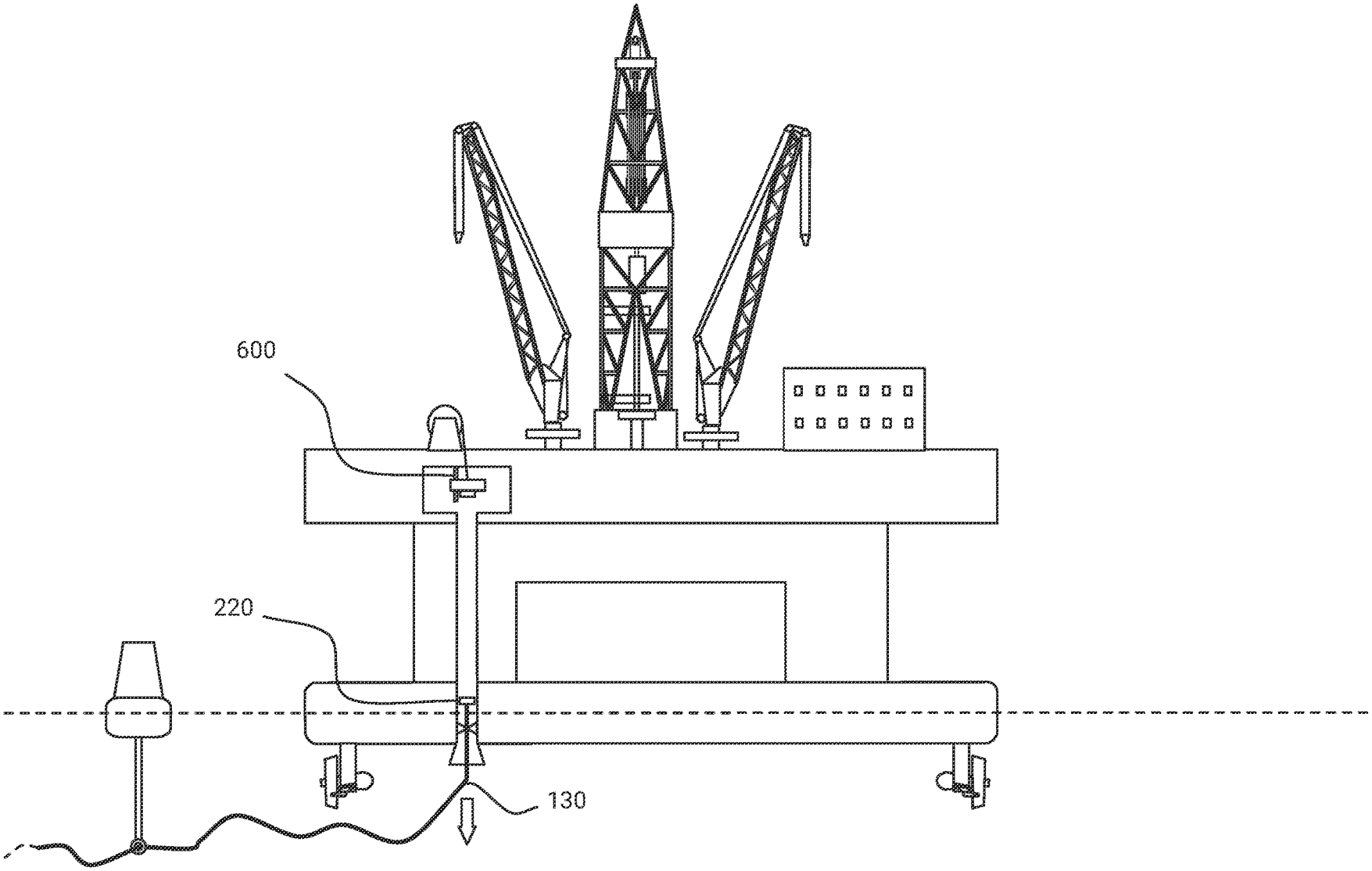

The emergency disconnect system 816 sends a signal to the one or more fasteners 812 to release the end 220 of the submersible cable 130 as shown in step 1004 of FIG. 10. For example, the active magnetic fasteners 812 are deenergised. As shown in FIG. 6, the active magnetic fasteners 812 are no longer energised and the end 220 of the submersible cable 130 drops down the conduit 202. The end 220 of the submersible cable 130 drops down the conduit 202 in the direction shown by the arrow in FIG. 6.

In some examples, the cable ejection mechanism 600 optionally is arranged to urge the end 220 of the submersible cable 130 towards the opening 200. In some examples, the cable ejection mechanism 600 comprises a pneumatic or hydraulic ram for rapidly pushing the end 220 of the submersible cable 130 away from the cable connector 212. The pneumatic or hydraulic ram increases the disconnection speed. In some examples, the magnetic polarity of the active magnetic fasteners 812 can be reversed to repel the first portion 216 away from the second portion 218.

In some examples, the end 220 of the submersible cable 130 is arranged to move from the raised position to the submersed position in less than five seconds when the cable ejection mechanism 816 is actuated. If the submersible cable 130 only falls under the force of gravity, then the conduit 202 has a maximum height of 120 m.

In some examples, the method of disconnecting the submersible cable 130 as described in reference to FIGS. 6 and 10 can be used for disconnecting the submersible cable 130 under normal circumstances. Under normal circumstances, the emergency disconnect system 816 does not send a signal to the one or more fasteners 812 to release the end 220 of the submersible cable 130. However, the controller 810 receives a disconnect instruction. For example the controller 810 receives a signal from a manual instruction inputted by an operator at a control panel. In some examples, the controller 810 may autonomously determine a normal disconnect from the submersible cable 130. Once the controller 810 receives or determines the instruction to disconnect, the controller 810 sends a signal to the one or more fasteners 812 to release the end 220 of the submersible cable 130. The release of the end 220 of the submersible cable 130 is the same as previously described.

Optionally, the end 220 of the submersible cable 130 comprises a "wet connection" or a "wet mate" connection. This means that the submersible cable 130 is arranged to make and break connections underwater and above the surface 104 of the water. This means if the submersible cable 130 is dropped into the water which is still energised, then there will not be an electrical safety issue.

In some examples, the controller 810 may be arranged to send a signal to the switchgear 802 to remove any load on the submersible cable 130 before disconnecting the submersible cable 130. Furthermore, a circuit breaker (not shown) associated with the submersible cable 130 is open before the disconnection of the submersible cable 130. This prevents sparks or arcing at the cable connector 212 during the disconnection.

In some examples, the controller 810 can be of a pure software character and include programming instructions described herein for detection of input conditions and control of output conditions, illustrated in FIG. 8 and discussed throughout. The programming instructions can be stored in a memory of controller 810, not shown. In some examples, the programming instructions correspond to the processes and functions described herein. The controller 810 can be executed by a hardware processor. The programming instructions can be implemented in C, C++, JAVA, or any other suitable programming languages. In some examples, some or all of the portions of the controller 810 can be implemented in application specific circuitry such as ASICs and FPGAs.

The methods described in reference to FIGS. 1 to 10 have been made in reference to the controller 810 remotely and autonomously controlling the capture and connection of the submersible cable 130. However, in alternative examples, one or more steps can be carried out manually. For example control of one or more of the cable lifting winch 226, the lifting winch gripper 230, the active magnetic fasteners 812, the ROV 300 and the ROV gripper 302 can be achieved remotely and manually.

In another example two or more examples are combined. Features of one example can be combined with features of other examples.

Examples of the present invention have been discussed with particular reference to the examples illustrated. However it will be appreciated that variations and modifications may be made to the examples described within the scope of the invention.

The invention claimed is:

1. An offshore drilling vessel configured to be powered by at least one submersible cable, and comprising:

a hull;

at least one opening in the hull arranged to receive an end of the at least one submersible cable;

a cable capture mechanism configured to lift the end of the at least one submersible cable through the at least one opening from a submersed position to a raised position;

a switch gear connected to a power bus for distribution of electrical power to the offshore drilling vessel; and a cable connector configured to couple to the end of the at least one submersible cable when the end of the at least one submersible cable is in the raised position for connecting the at least one submersible cable to the switch gear, whereby the offshore drilling vessel comprises an external power connection via the submersible cable, and wherein the cable connector comprises a cable ejection mechanism.

2. The offshore drilling vessel according to claim 1, wherein the vessel further comprising one or more network switches connected to a vessel data network of the offshore drilling vessel and adapted for data communication via the at least one submersible cable.

3. The offshore drilling vessel according to claim 1, wherein the cable connector comprises a slip ring for permitting relative rotational movement between the end of the submersible cable and the offshore drilling vessel.

4. The offshore drilling vessel according to claim 3, wherein the cable connector comprises a portion mounted on the offshore drilling vessel engageable with another portion mounted on the end of the at least one submersible cable, and in that the first portion and the second portion are selectively engageable.

5. The offshore drilling vessel according to claim 4, wherein the first portion and the second portion are selectively engageable to each other with one or more magnetic fasteners.

6. The offshore drilling vessel according to claim 5, wherein the first portion is mounted to the slip ring.

7. The offshore drilling vessel according to claim 1, wherein the cable capture mechanism comprises a lifting cable and winch for lifting the end of the at least one submersible cable between the submersed position and the raised position.

8. The offshore drilling vessel according to claim 7, wherein the cable capture mechanism is adapted to collaborate with a remotely operated underwater vehicle when capturing the free end of the at least one submersible cable in the submersed position.

9. The offshore drilling vessel according to claim 8, wherein the lifting cable comprises a gripper which is selectively engageable with the end of the at least one submersible cable.

10. The offshore drilling vessel according to claim 1, wherein the hull comprises a conduit extending between the at least one opening and the cable connector, and in that the conduit comprises at least one valve for selectively allowing passage of the at least one submersible cable through the conduit.

11. The offshore drilling vessel according to claim 1, wherein the offshore drilling vessel is a semi-submersible drilling rig and the at least one opening is located in one or more pontoons of the vessel.

12. The offshore drilling vessel according to claim 1, wherein the cable ejection mechanism releases the end of the at least one submersible cable from the cable connector.

13. The offshore drilling vessel according to claim 1, wherein the offshore drilling vessel comprises a cable tension sensor for detecting the tension in the submersible cable.

14. A method of connecting an offshore drilling vessel to a submersible cable for providing an external data and/or power connection, and comprising:

receiving an end of at least one submersible cable through at least one opening in a hull of the offshore drilling vessel;

lifting the end of the at least one submersible cable through the at least one opening from a submersed position to a raised position;

coupling to the end of the at least one submersible cable when the end of the at least one submersible cable is in the raised position to a switch gear connected to a power bus for distribution of electrical power to the offshore drilling vessel, whereby the offshore drilling vessel comprises an external power connection via the submersible cable;

determining whether the offshore drilling vessel has met an emergency disconnect condition; and releasing the end of the submersible cable when the emergency disconnect condition has been met.

15. The method according to claim 14, wherein the method further comprises connecting the end of the at least one submersible cable to one or more network switches connected to a vessel data network of the offshore drilling vessel, whereby the submersible cable provides external an data connection the offshore drilling vessel.

16. The method according to claim 14, wherein the providing of the external power connection comprises connecting the offshore drilling vessel to an onshore electrical power generation and distribution network or to an offshore power generation installation via the submersible cable.

17. An offshore drilling vessel configured to be powered by at least one submersible cable, and comprising:

a hull;

at least one opening in the hull arranged to receive an end of the at least one submersible cable;

a cable capture mechanism configured to lift the end of the at least one submersible cable through the at least one opening from a submersed position to a raised position;

a switch gear connected to a power bus for distribution of electrical power to the offshore drilling vessel;

a cable connector configured to couple to the end of the at least one submersible cable when the end of the at least one submersible cable is in the raised position for connecting the at least one submersible cable to the switch gear, whereby the offshore drilling vessel comprises an external power connection via the submersible cable; and wherein the hull comprises a conduit extending between the at least one opening and the cable connector, and in that the conduit comprises at least one valve for selectively allowing passage of the at least one submersible cable through the conduit.

18. An offshore drilling vessel configured to be powered by at least one submersible cable, and comprising:

a hull;

at least one opening in the hull arranged to receive an end of the at least one submersible cable;

a cable capture mechanism configured to lift the end of the at least one submersible cable through the at least one opening from a submersed position to a raised position;

a switch gear connected to a power bus for distribution of electrical power to the offshore drilling vessel;

a cable connector configured to couple to the end of the at least one submersible cable when the end of the at least one submersible cable is in the raised position for connecting the at least one submersible cable to the switch gear, whereby the offshore drilling vessel comprises an external power connection via the submersible cable;

the cable capture mechanism comprises a lifting cable and winch for lifting the end of the at least one submersible cable between the submersed position and the raised position; and wherein the cable capture mechanism is adapted to collaborate with a remotely operated underwater vehicle when capturing the free end of the at least one submersible cable in the submersed position.

* * * * *